US006669538B2

(12) United States Patent
Li et al.

(10) Patent No.: US 6,669,538 B2
(45) Date of Patent: Dec. 30, 2003

(54) PAD CLEANING FOR A CMP SYSTEM

(75) Inventors: Shijian Li, San Jose, CA (US); Ramin Emami, San Jose, CA (US); Sen-Hou Ko, Cupertino, CA (US); Shi-Ping Wang, Fremont, CA (US); Fred C. Redeker, Fremont, CA (US); Lizhong Sun, Sunnyvale, CA (US); Stan Tsai, Fremont, CA (US)

(73) Assignee: Applied Materials Inc, Santa Clara, CA (US)

( * ) Notice: Subject to any disclaimer, the term of this patent is extended or adjusted under 35 U.S.C. 154(b) by 0 days.

(21) Appl. No.: 09/512,745

(22) Filed: Feb. 24, 2000

(65) Prior Publication Data

US 2002/0090896 A1 Jul. 11, 2002

(51) Int. Cl.[7] ..... B24B 1/00
(52) U.S. Cl. ..... 451/56; 451/60
(58) Field of Search ..... 451/56, 57, 60, 451/67, 443, 444, 446, 72, 456

(56) References Cited

U.S. PATENT DOCUMENTS

| | | | | |
|---|---|---|---|---|
| 4,680,893 A | | 7/1987 | Cronkhite et al. | |
| 5,154,021 A | | 10/1992 | Bombardier et al. | |
| 5,421,768 A | | 6/1995 | Fujiwara et al. | |
| 5,486,265 A | | 1/1996 | Salugsugan | |
| 5,578,529 A | | 11/1996 | Mullins | |
| 5,616,069 A | | 4/1997 | Walker et al. | |
| 5,645,682 A | | 7/1997 | Skrovan | |
| 5,651,725 A | | 7/1997 | Kikuta et al. | |
| 5,702,563 A | | 12/1997 | Salugsugan et al. | |
| 5,704,987 A | | 1/1998 | Huynh et al. | |
| 5,738,574 A | | 4/1998 | Tolles et al. | |
| 5,755,614 A | | 5/1998 | Adams et al. | |
| 5,779,522 A | | 7/1998 | Walker et al. | |
| 5,893,753 A | | 4/1999 | Hempel, Jr. | |
| 5,916,010 A | * | 6/1999 | Varian et al. | 451/38 |
| 5,957,757 A | * | 9/1999 | Berman | 451/56 |
| 6,053,801 A | * | 4/2000 | Pinson et al. | 451/56 |
| 6,139,406 A | * | 10/2000 | Kennedy et al. | 451/67 |
| 6,168,502 B1 | * | 1/2001 | Allman et al. | 451/38 |

FOREIGN PATENT DOCUMENTS

| | | | |
|---|---|---|---|
| EP | 0887153 A2 * | 12/1998 | B24B/37/04 |
| JP | 3-10769 | 1/1991 | |

OTHER PUBLICATIONS

SI: Applied Materials [AMAT] (#25936/32701) Internet Article Dated Oct. 1, 1999, 2 pages.
"Applied to Acquire Startup Obsidian" Dated Jun. 1, 1999, 4 pages.
"Study of CMP Polishing pad Control Method", Inaba, S.; Katsuyama, T; Tanaka, M. 1998 CMP–MIC Conference, Feb. 19–20, 1998, pp. 44–50.

* cited by examiner

*Primary Examiner*—Dung Van Nguyen
(74) *Attorney, Agent, or Firm*—Moser, Patterson & Sheridan

(57) ABSTRACT

The present invention generally provides a system and apparatus for cleaning a polishing pad, such as a fixed abrasive pad, in a substrate processing system. In one embodiment, the system includes one or more nozzles which spray a fluid at pressures of about 30 psi to about 300 psi or greater, as measured at the nozzle, onto a polishing pad at acute angles to the surface of the polishing pad. The nozzles can spray downward and outward toward the perimeter of the pad to facilitate the debris removal therefrom. The system can include a pressure source to produce a sufficient fluid pressure substantially higher than the typical fluid pressure available from a facility installation.

7 Claims, 7 Drawing Sheets

PAD CLEANING FOR A CMP SYSTEM

BACKGROUND OF THE INVENTION

1. Field of the Invention

The present invention relates to planarization and polishing of substrates in a substrate processing system. More specifically, the present invention relates to methods and apparatus for cleaning a pad in a planarization and polishing system.

2. Description of the Related Art

Integrated circuits are typically formed on substrates, particularly silicon wafers, by the sequential deposition of conductive, semi-conductive or insulative layers. After each layer is deposited, the layer is etched to create circuitry features. As a series of layers are sequentially deposited and etched, the uppermost surface of the substrate may become non-planar across the substrate surface and require planarization. The non-planarity occurs when the thickness of the layers formed on the substrate varies across the substrate surface as a result of the non-uniform geometry of the circuits formed thereon.

Chemical mechanical polishing (CMP) is one accepted method of planarization. In CMP, a substrate is typically placed face down on a polishing pad located on a large rotatable platen. The polishing pad can be a removable pad attached to the platen for a useful life of the pad and then replaced. Alternatively, the pad can be a sheet of polishing material that is incrementally indexed across a rectangularly shaped platen as the material wears. This type of system is conventionally known as a "web" system. A carrier holds the substrate and applies pressure to the back of the substrate to hold the substrate against the polishing pad during polishing.

In a slurry-based system, a mixture of abrasives and chemicals is delivered to the polishing pad to chemically passivate or oxidize the film being polished and abrasively remove or polish off the surface of the film. A reactive agent in the slurry reacts with the film on the surface of the substrate to facilitate polishing. The interaction of the polishing pad, the abrasive particles, and the reactive agent with the surface of the substrate results in controlled polishing of the desired film.

However, the slurry delivered to the polishing pad can coagulate with the material being removed from the substrate and clog the grooves or pore structure on the pad, thereby reducing the effectiveness of the planarization process and increasing the likelihood of poor planarization performance. Further, the polishing process creates debris on the pad that can scratch the substrate during subsequent polishing. Additionally, in a web polisher, corners of rectangular polishing sheets that do not initially engage the substrate are susceptible to clogging with debris from a central area that does engage the substrate. When the sheet of polishing pad material is indexed so that the material that was at the corners is moved to a position to polish the substrate, the coagulated debris can cause scratches and defects in the substrate during polishing. Thus, it is important to thoroughly clean the debris from the pad.

As another example of polishing pads that need debris removal, recent efforts in the field of substrate processing have developed a planarization system using a polishing pad known as a fixed abrasive pad that does not require a slurry. The fixed abrasive pad includes a plurality of microscopic pedestals that abrade the substrate in the planarization process. However, the debris generated from pad asperity may scratch the substrate, thereby requiring replacement or cleaning of the pad.

Prior efforts at cleaning slurry-based polishing pads, such as brushing the debris, are not effective in removing debris lodged between the pedestals on a fixed abrasive pad. Generally, the size of brush bristles is larger than the spacing between the pedestals and therefore do not provide effective cleaning between the pedestals. Another technique which has been used to clean polishing pads is "high pressure" de-ionized water rinse. However, heretofore the "high pressure" deionized water is delivered to the pad directly downward or at too low a pressure at the nozzle and the rinse does not remove or sweep debris from the pad.

Therefore, there remains a need for a system and method for cleaning polishing pads in a substrate processing system and particularly for cleaning fixed abrasive pads.

SUMMARY OF THE INVENTION

The present invention generally provides a system and apparatus for cleaning a polishing pad, such as a fixed abrasive pad, in a substrate processing system. In one embodiment, the system includes one or more nozzles which spray a fluid at pressures of about 30 psi to about 300 psi or greater, as measured at the nozzle, onto a polishing pad at acute angles to the surface of the polishing pad. The nozzles can spray downward and outward toward the perimeter of the pad to facilitate the debris removal therefrom. The system can include a pressure source to produce a sufficient fluid pressure substantially higher than the typical fluid pressure available from a facility installation.

In one aspect, the invention provides an apparatus for polishing a substrate, comprising a rinse fluid rinse arm disposed above the polishing pad, and one or more nozzles coupled to the rinse arm and mounted to spray the rinse fluid at an acute angle to the polishing pad. In another aspect, the invention provides an apparatus for polishing a substrate on a polishing pad, comprising a rinse arm disposed above the polishing pad, and one or more nozzles coupled to the rinse arm that direct a rinse fluid to the polishing pad at a rinse fluid pressure at least about 30 psi to rinse the pad.

In another aspect, the invention provides a system for polishing a substrate on a polishing pad, comprising a rinse arm disposed above the polishing pad, one or more nozzles coupled to the rinse arm, and a vacuum arm disposed above the polishing pad. In another aspect, the invention provides a system for polishing a substrate on a polishing pad, comprising a base, one or more carriers supported above the base, a rinse fluid rinse arm disposed above the polishing pad, and one or more nozzles coupled to the rinse arm and mounted to spray the rinse fluid at an acute angle to the polishing pad.

BRIEF DESCRIPTION OF THE DRAWINGS

So that the manner in which the above recited features of the present invention are attained and can be understood in detail, a more particular description of the invention, briefly summarized above, may be had by reference to the embodiments thereof which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

The present invention provides a cleaning system for a polishing pad used in a CMP system. The invention will be described below in reference to a high pressure rinse assembly for polishing substrates in a CMP system. The high pressure rinse assembly includes a pressure source that pressurizes the fluid to a desirable pressure. In another aspect, the invention provides a vacuum system for cleaning the surface of the polishing pad and can be used while the substrate is being polished.

Figure 1:
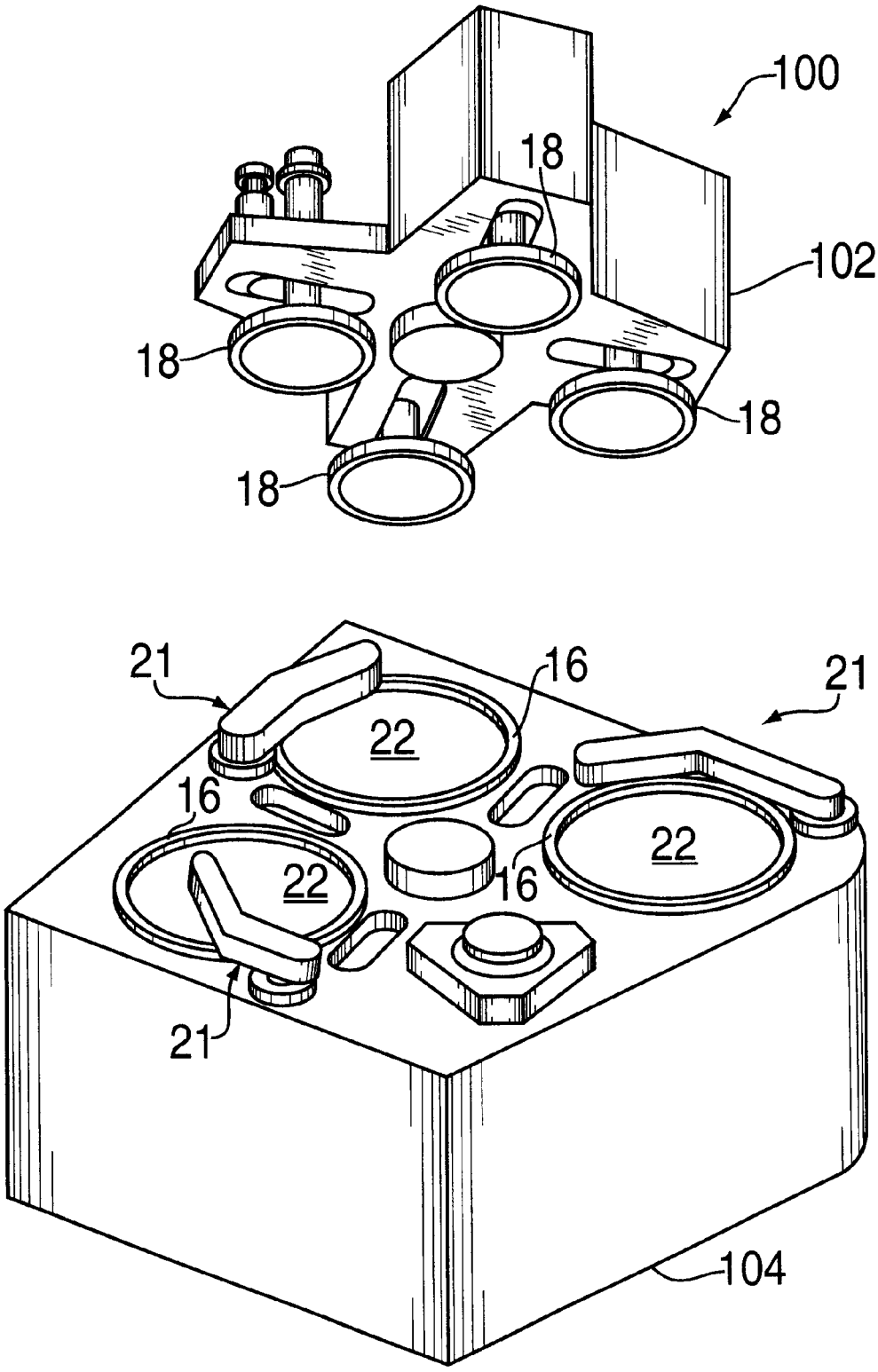
FIG. 1 is a schematic side view of a CMP system.

FIG. 1 is schematic of a multi-pad CMP system 100 representative of the MIRRA™ system available from Applied Materials, Inc. of Santa Clara, Calif. One or more platens 16 are mounted to a base 104. One or more polishing pads 22, such as a fixed abrasive pad by 3M Company of St. Paul, Minn., or other type polishing pads are disposed on the platens 16. One or more fluid delivery systems 21 having nozzles (not shown) are disposed adjacent the pads 22. An upper carousel portion 102 supports one or more carriers 18. Substrates (not shown) are supported by the carrier.

Typically, a substrate (not shown) is positioned or chucked to a carrier 18 which positions the substrate on the polishing pad 22 and confines the substrate on the pad. The polishing pad 22 is typically rotated and the substrate may also be rotated within the carrier 18. Slurry or a polishing chemical is delivered to an area close to the center of the pad. Additionally, the carrier 18 may be moved radially across the surface of the polishing pad 22 to enhance uniform polishing of the substrate surface and uniform wearing of the pad. The substrate surface is polished according to a pre-selected recipe. Towards the end of the polishing, a rinse agent, such as deionized water, an ammonium peroxide mixture or other known agent, is delivered to the pad via the nozzles (not shown) on the rinse arm to rinse the polishing pad and the substrate. The rinse agent is delivered to the polishing pad for a period of about 5 to about 20 seconds during which time the substrate can be raised from the polishing pad 22 and the carrier 18 is moved either to the next processing position in multiple platen systems and/or into position for unloading the substrate and loading the next substrate for processing. The pressure to the nozzle, and hence flow rate, can be reduced to wash small particles from the substrate as the substrate is raised from the pad to avoid possible damage to the substrate from debris that may be disturbed by the rinse agent at higher pressure. Once the substrate is removed from the pad, the fluid pressure can be greatly increased to dislodge and push away the debris from the pad.

Figure 2:
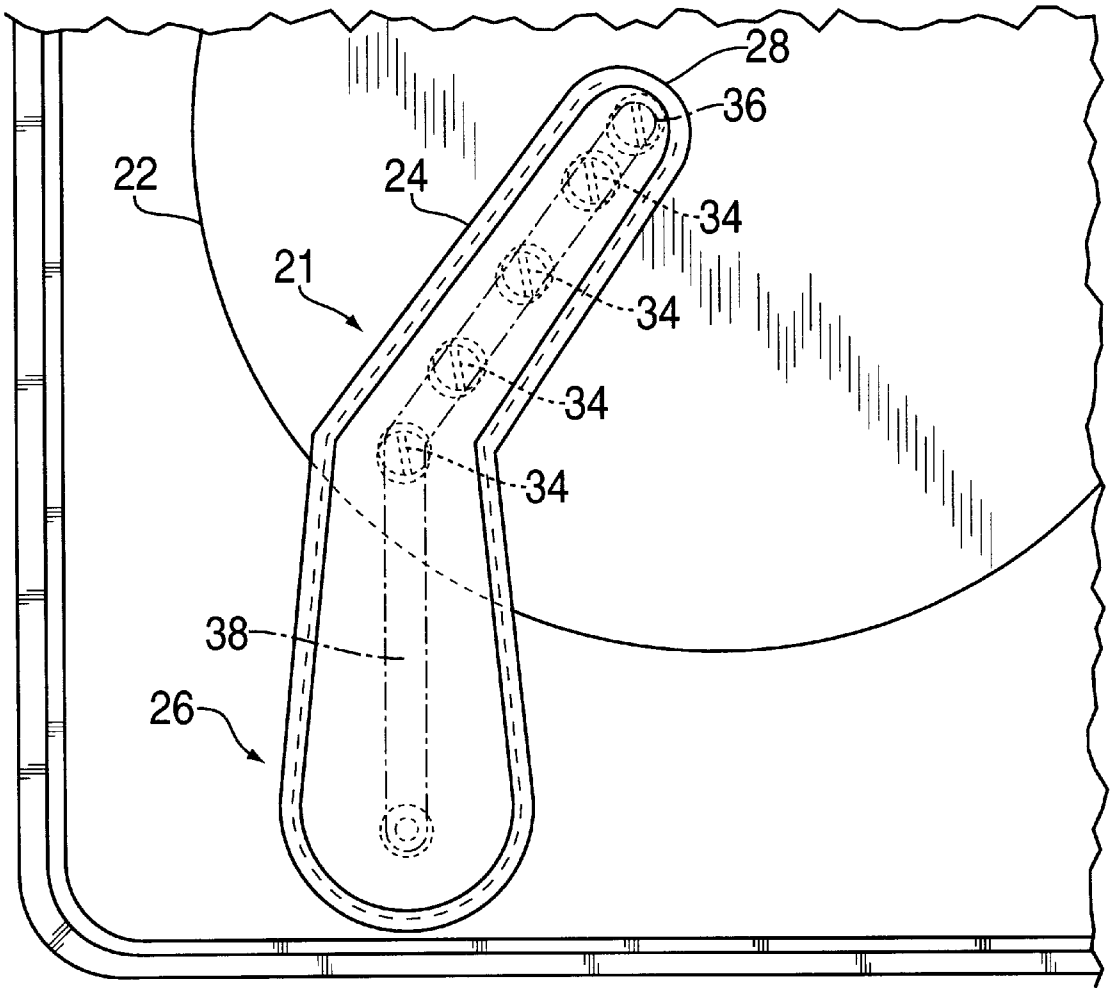
FIG. 2 is a schematic top view of a portion of a CMP system having one embodiment of a fluid delivery system.

FIG. 2 is a schematic top view of a portion of a CMP system having one embodiment of a fluid delivery system 21 of the present invention disposed over a polishing pad 22. The fluid delivery system includes a rinse arm 24 having a base portion 26 disposed outwardly from the edge of the pad and an end portion 28 disposed adjacent the pad center. The base portion 26 is mounted on a shaft 40 (shown in FIG. 3) to enable rotation of the rinse arm 24 between a processing position over the polishing pad and a maintenance position adjacent the pad. The arm is generally angled from its base portion 26 to its end portion 28, though the arm may be straight. One or more slurry or polishing chemical delivery lines (not shown) can be mounted along the arm and the chemical(s) can be delivered to the end portion 28 of the arm. A central rinse agent delivery line 38 delivers one or more rinse agents to a plurality of outlets, herein "nozzles", 34, 36, mounted to the lower surface 44 of the fluid rinse arm. The end portion 28 preferably terminates at or close to the center of the pad 22 to allow the whole pad to be cleaned as long as the arm can move radially across the pad approaching the center of the pad during polishing without the arm colliding with the carrier (shown in FIG. 1). A nozzle 36 is disposed on the end portion of the arm to deliver rinse agents to the center of the pad. Alternatively, a straight arm or an angled arm extends over the center of the pad and mounts a nozzle 36 at or near the distal end of the arm to deliver rinse agent to the central portion of the pad. The rinse agent can be delivered at the nozzle at pressures of about 30 psi to about 300 psi at the nozzle for sufficiently dislodging debris accumulated on the pads. De-ionized water house pressures can range from about 15 psi up to about 100 psi, typically about 80 psi. However, because of flow constraints, even with an 80 psi system, the pressure at the nozzle can become reduced to about 10 psi for a six-nozzle rinse arm system. Thus, a pressure vessel, described in FIG. 6, can be used to increase the pressure to the preferable levels at the nozzle.

Figure 3:
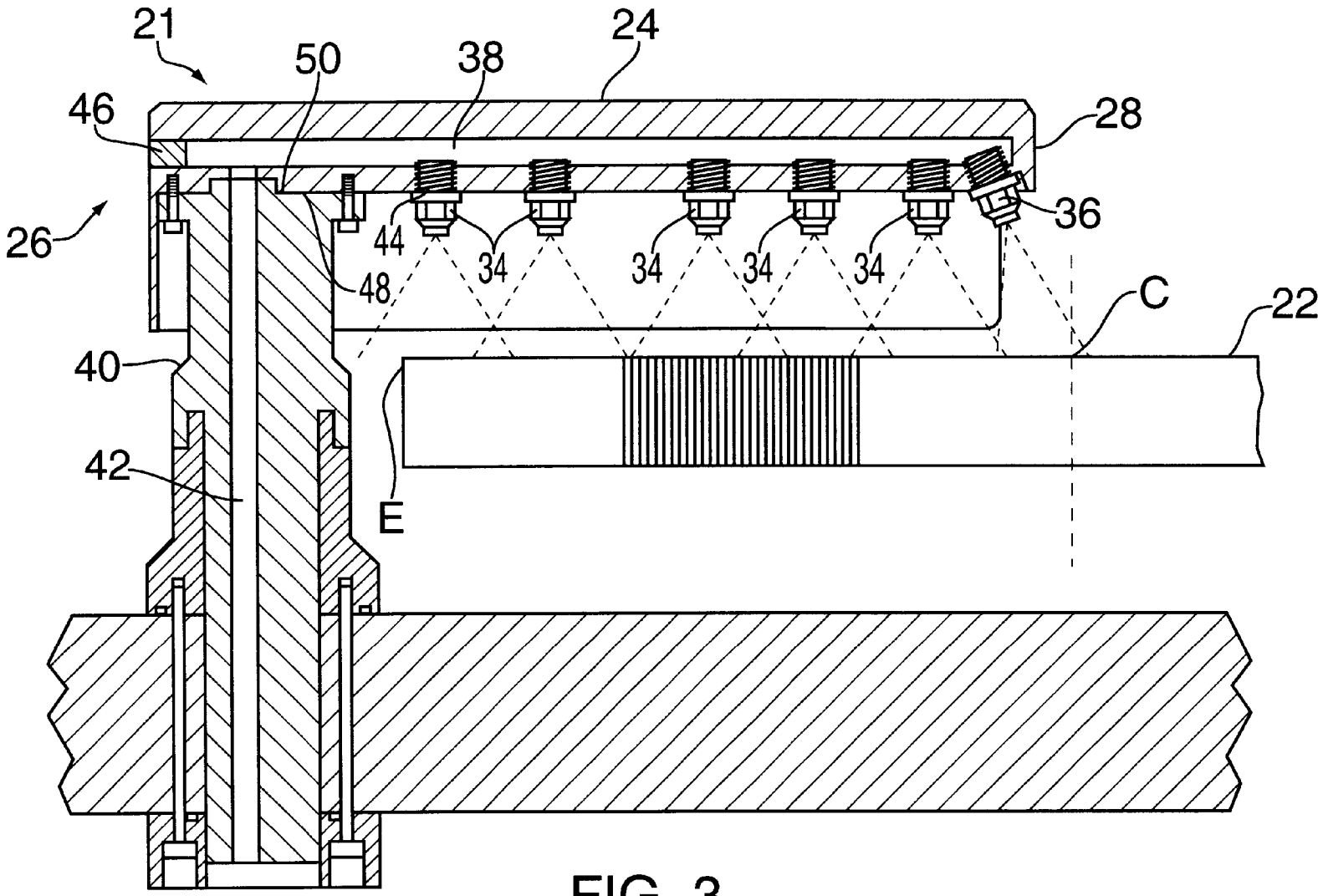
FIG. 3 is a schematic cross sectional view of the fluid delivery assembly.

FIG. 3 is a schematic cross sectional view of the fluid delivery assembly 21, showing the rinse agent delivery line 38 and the mounting shaft 40. Slurry or chemical delivery lines are not shown. The shaft 40 defines a vertical rinse agent channel 42 which delivers a fluid to the fluid rinse arm 24. The arm similarly defines a longitudinal channel or delivery line 38 which terminates at the end portion 28. A plug 46 may be disposed in one end or both ends of the channel depending on the process used to machine the channel or line 38. The rinse agent channel 42 delivers one or more rinse agents to the channel or fluid delivery line 38 of the arm 24 from a source (not shown) provided in conjunction with a CMP system. A seal is provided between the shaft 40 and the arm 24 that allows the arm to rotate with the shaft. The channels 42, 38 may be machined channels or may be tubing disposed through and secured in the shaft and the arm.

A series of nozzles 34, 36 are threadably mounted in or otherwise disposed on the lower surface 44 of the arm and are connected to the rinse agent delivery line 38. In one embodiment, the spray nozzles are threadably mounted along the length of the arm having the spray patterns shown. The end nozzle 36 may be disposed at a different acute angle to the plane of the arm compared to other nozzles mounted along the arm to deliver a fluid a distance away from the end portion 28 of the arm towards the central portion C of the pad 22. The nozzle spray from each nozzle preferably overlaps the spray from an adjacent nozzle to insure that each region of the pad is cleaned. The nozzles are preferably fine-tipped nozzles which deliver the rinse agent in a fan-shaped plane. One example of nozzles which can be used to advantage are available, for example, from Spraying Systems company, Wheaton, Ill., under model Veejet Spray Nozzle, Kynar Series. In a preferred embodiment, the nozzles deliver fluid in an overlapping pattern to insure that the whole pad is subjected to the spray from the nozzles when the pad rotates. The nozzles may include spray patterns which direct the rinse agent downwardly and outwardly over the surface of the pad towards the edge E of the pad 22.

It is believed that directing the spray via nozzles 34, 36 downwardly and outwardly over the pad surface may enhance removal of material and cleaning of the pad surface. Nozzles 34, 36 direct rinse agent, set at an optimal pressure to provide sufficient momentum from the rinse agent between pad 22 and the rinse arm 24, such that a disturbance is caused, thereby lifting and suspending very small particles in the volume of liquid. Larger particles, such as chips from the fixed abrasive pad pedestals or delaminated films from the substrate, can be swept by the momentum of the spray to the outside edge of the pad. Preferably, the rinse is performed for about 5 to about 20 seconds. The polishing pad continues to rotate as the rinse agent is delivered to the pad. The rinse may continue until another carrier carrying another substrate is moved into position above the pad concerned and is ready to be polished.

Figure 4:
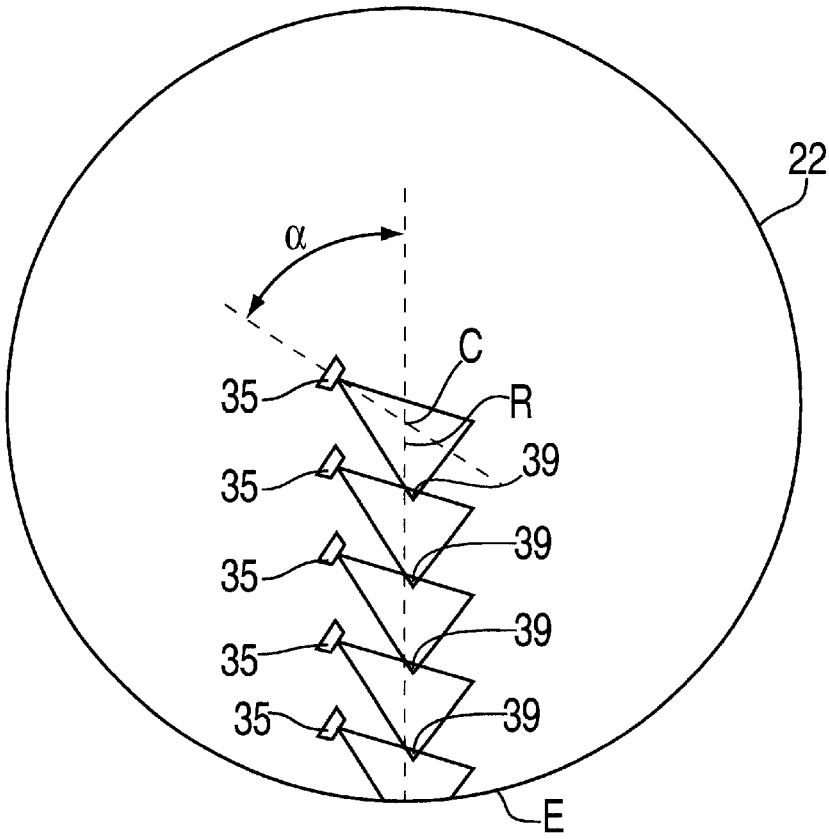
FIG. 4 is a schematic top view of a spray pattern of a series of nozzles.

FIG. 4 is a schematic top view of a spray pattern of a series of nozzles 35, such as nozzles 34, 36. The nozzles 35 are disposed at an angle $\alpha$ to a radius R of the pad 22. The angle a is acute and can vary between about 5° to about 85° to the radius R and is preferably between about 40° to about 50°. Preferably, the nozzles 35 are disposed so that the spray pattern of one nozzle overlaps the spray pattern of an adjacent nozzle at least radially. Preferably, at least one of the nozzles 35 is also disposed so that the spray pattern overlaps the edge E of the pad 22.

Figure 5:
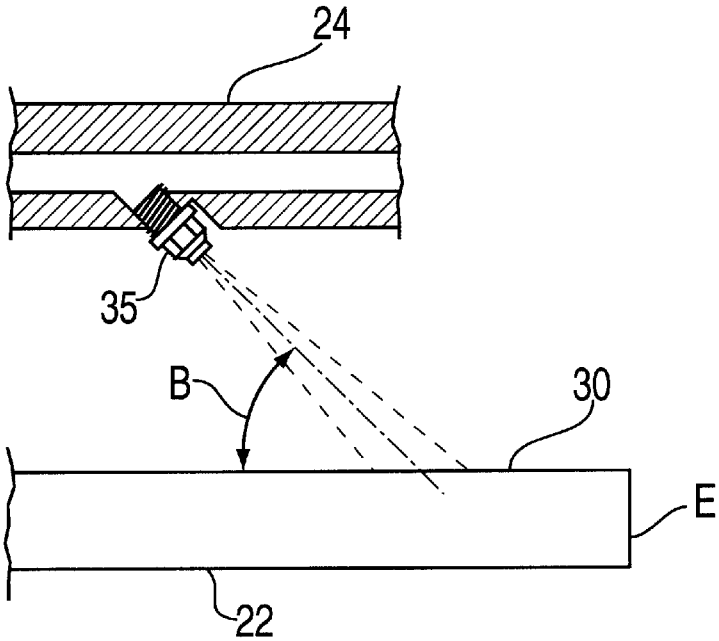
FIG. 5 is a schematic side view of an angled spray pattern of a nozzle.

FIG. 5 is a schematic side view of an angled spray pattern of a nozzle 35. The nozzle 35 is fan-shaped, and thus, shows a line of spray from the point of view of the figure. The nozzle 35 is also disposed at an angle $\beta$ to the surface 30 of the pad 22. The angle $\beta$ is acute and can vary between about 5° to about 85° to the surface of the pad 22 and is preferably between about 40° to about 50°. The nozzle 35 disposed at angle $\beta$ directs the rinse fluid toward the edge E of the pad 22 preferably in conjunction with the angle $\alpha$, shown in FIG. 4.

Figure 6:
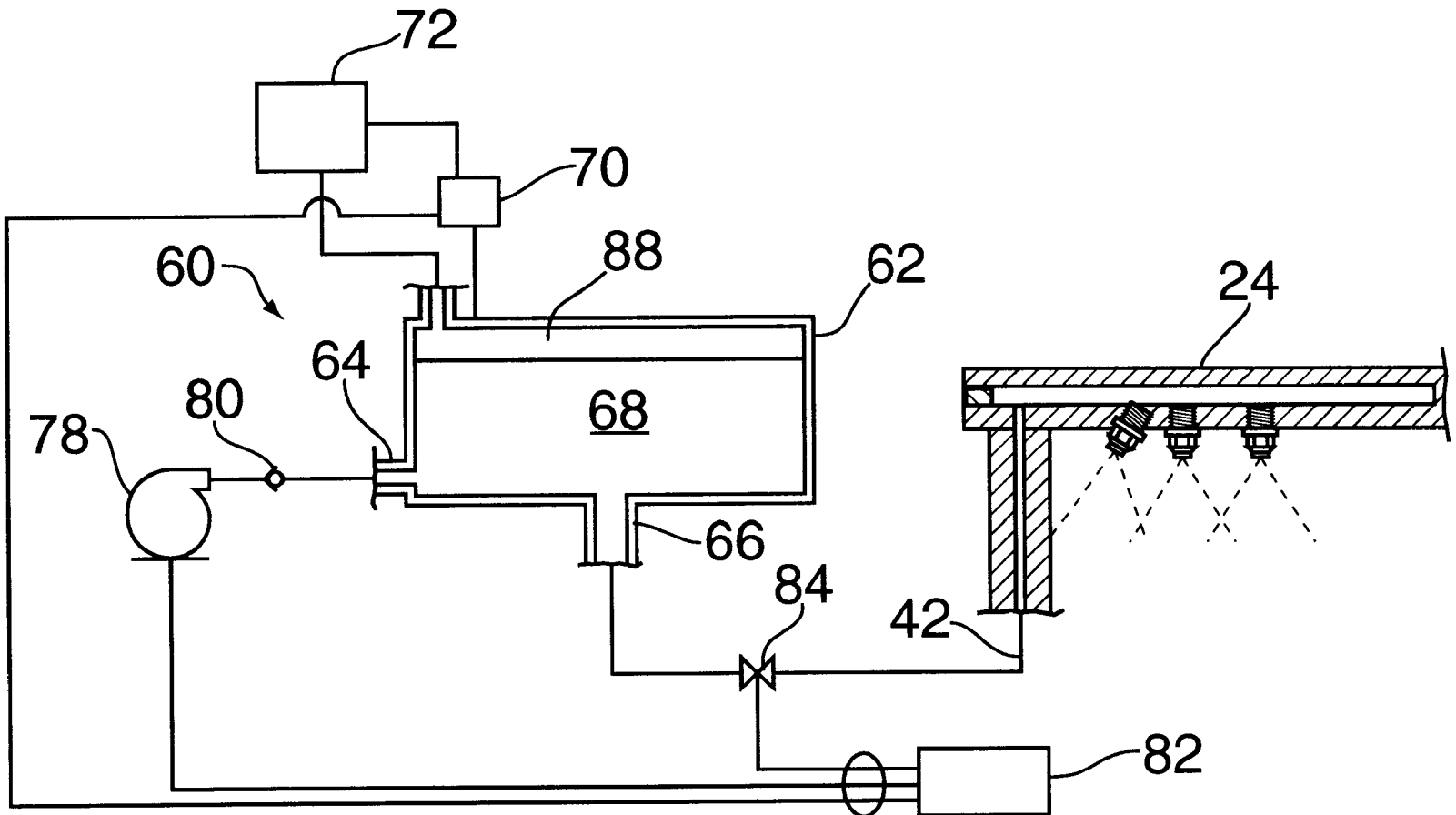
FIG. 6 is a schematic perspective view of a pressure vessel.

FIG. 6 is a schematic perspective view of one embodiment of a pressure vessel 60 of the fluid delivery system. The pressure vessel can include a chamber 62 having an inlet 64 and an outlet 66. The pressure vessel 60 is used for deionized water storage and as a pressure source that increases the pressure from the de-ionized water facility pressure or from a water pump. A typical quantity of rinse fluid can be about one gallon to about five gallons per pad per rinse cycle. A quantity 68 of the rinse fluid is contained in the chamber 62. An air pump 72 provides a quantity of pressurized air to the chamber 62. The air pump, and, thus, the pressure on the quantity 68 of rinse fluid is controlled by an air pressure regulator 70. A pump 78 is coupled to the inlet 64 through a valve 80, such as a check valve. The pump 78 is preferably a diaphragm pump that reduces the entry of contaminants into the fluid. The outlet 66 of the chamber 62 is coupled to the inlet of the channel 42 of the rinse arm 24 through a valve 84, which can be a remotely operated valve. A controller 82 through lines 86 is coupled to the pump 78, the valve 84 and pressure regulator 70. The fluid pressure delivered to the nozzle is at least about 30 psi to about 300 psi or more. For pads capable of withstanding higher pressures without substantial damage, a higher pressure system is contemplated to deliver higher pressures to the nozzles. Therefore the disclosed pressures are not limited to about 300 psi and can range up to 1000 psi or more.

Other pressure sources can include pumps without the chamber 62. For example, a pump having a flow capacity sufficient to flow the fluid into the channel 42 during the rinse cycle could be used. The pump could be operated on an "as needed" basis or could be continuously operated during processing and recycle fluid through a piping circuit when the fluid is not being delivered into the rinse arm 24. Pumps can include, for example, rotary and piston pumps. For pumps, such as rotary and piston pumps, that may introduce contaminants into the system, a filter (not shown) can be disposed between the outlet 66 and the channel 42.

In operation, the controller 82 turns on the pump 78 to pump a quantity 68 of fluid into the chamber 62 and then shut off the pump. A substrate disposed in the carrier 18 contacts the polishing pad 22. The carrier, including the substrate disposed therein, and the pad 22 can be rotated. The slurry or polishing chemical is delivered to an area close to the center of the pad. Relative motion between the carrier supporting the substrate and the pad and pressure exerted on the substrate cooperate to polish and planarize the substrate on the pad. During chucking and dechucking of the substrate, that is, insertion and removal of the substrate on and from the pad, the nozzles can deliver lower pressure rinse to the pad and substrate. Debris produced from a pad pre-polishing break-in process or the polishing process itself builds up on the pad. The controller 82 presets the chamber pressure by controlling the regulator 70. At the appropriate stage of polishing when the pad is to be rinsed, the controller opens the valve 84. Chamber pressure 68 forces the fluid through the outlet 66, through the valve 84, through the filter, if present, into the channel 42 and then through the rinse arm 24. Rinse fluid is delivered from the rinse arm 24 through the nozzles and onto the polishing pad to dislodge the debris. Furthermore, with the pad rotation, the rinse fluid moves the debris preferably toward an outside edge of the pad and, thus, the debris is removed from the pad. A typical rinse cycle lasts less than about 15 seconds and a typical polishing cycle lasts from about one minute to several minutes. Thus, the pump is preferably sized to refill the chamber 62 with the quantity 68 of fluid between rinse cycles.

Figure 7:
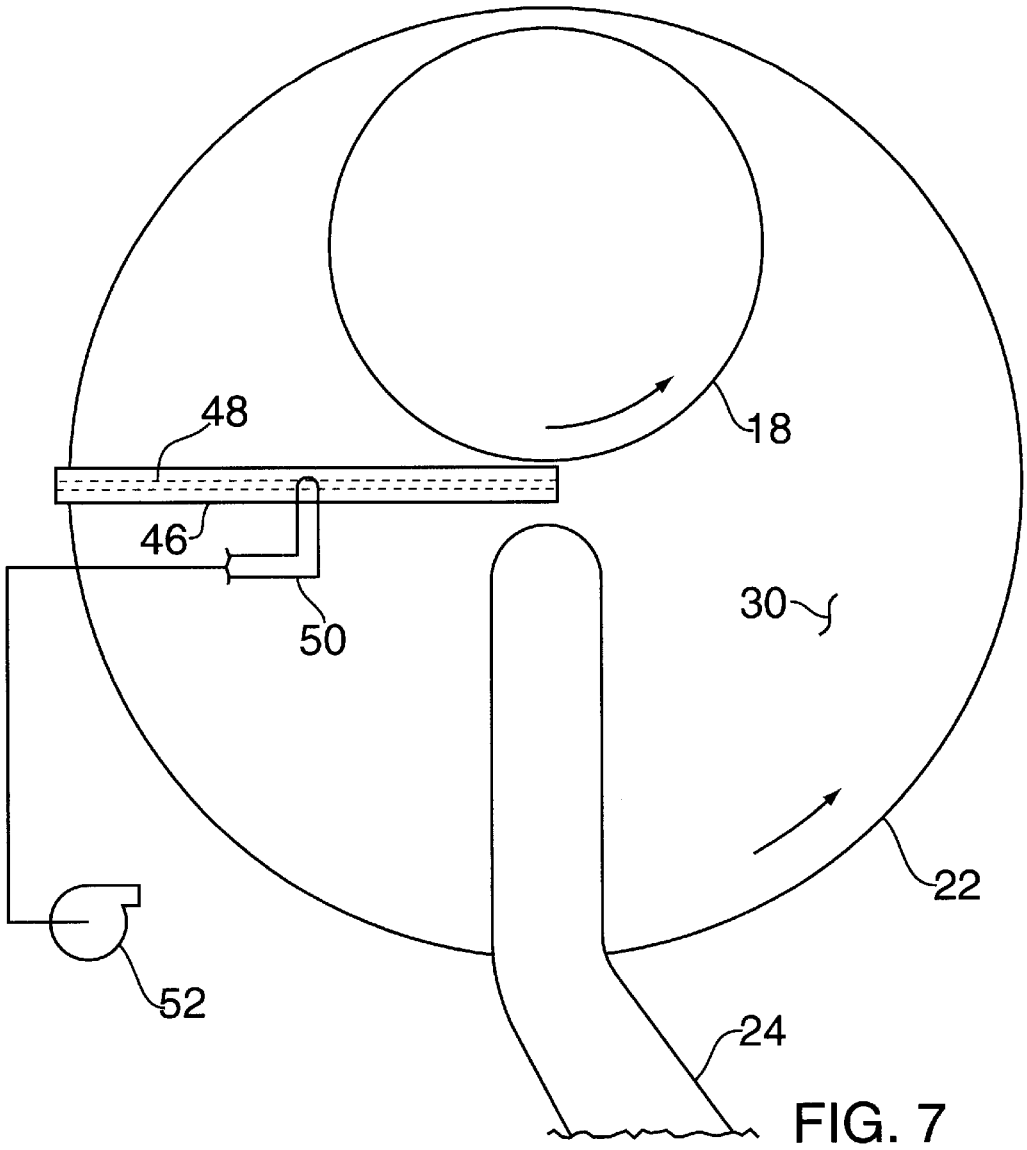
FIG. 7 a schematic top view of another embodiment of the fluid delivery system.

FIG. 7 is a schematic top view of another embodiment of the fluid delivery system. A rinse arm 24 is disposed above the pad 22. A carrier 18 for the substrate is rotationally offset from the rinse arm 24 and disposed above the pad 22. A vacuum arm 46 having a vacuum opening(s) 48 is disposed above a polishing pad 22 and rotationally offset from the carrier 18. The vacuum opening 48 can be a slit disposed in the lower portion of the vacuum arm 46 and preferably extends across the surface of the pad 22. The vacuum opening 48 is preferably disposed from about 0 mm, i.e., contacting the pad, for example, with a rubber gasket, to a spacing of about 4 mm above the pad, depending on the vacuum in the vacuum opening and the amount and quality of debris from the substrate or other debris-producing members. Alternatively, the vacuum opening 48 can include a series of holes disposed along the vacuum arm 46.

Figure 8:
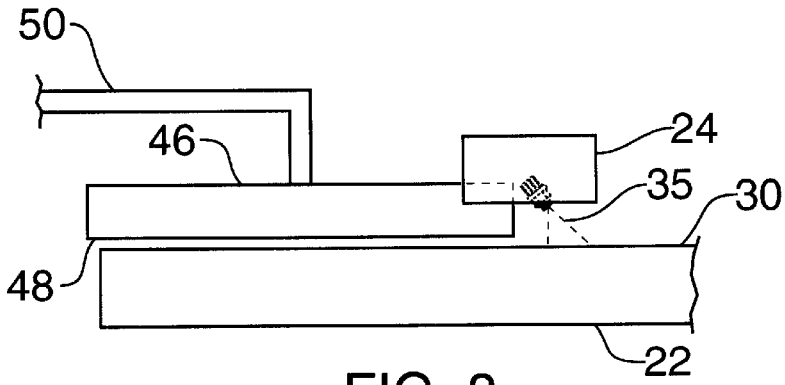
FIG. 8 is a schematic side view of the embodiment shown in FIG. 7.

FIG. 8 is a schematic side view of one embodiment of the vacuum arm 46 shown in FIG. 7. The rinse arm 24 is disposed above the pad 22 and contains one or more nozzles 35 that spray a fluid at an angle to the pad surface. The vacuum arm 46 can be rotationally disposed between the rinse arm 24 and the carrier 18. A vacuum arm 46 is disposed above the pad preferably in close proximity to the pad surface 30 to increase the efficiency of the vacuum suction on the pad surface. A vacuum source 52 provides a vacuum through a vacuum conduit 50 to the vacuum arm 46. A filter 54 is disposed between the vacuum opening 48 and the vacuum source 52 to filter debris from the pad prior to the vacuum source.

In operation, the pad 22 and carrier 18 are in relative movement and polish a substrate (not shown) disposed in the carrier. Pad debris and polishing byproducts on the pad 22 are suctioned from the pad surface by the vacuum arm 46. As the substrate is removed, remaining debris is washed from the pad surface toward a pad perimeter by rinse fluid delivered by nozzle(s) 35 that are disposed at an angle to the surface of the pad 22. Vacuuming the pad can occur in-situ, i.e., while the substrate is being polished, but the high pressure pad cleaning occurs ex situ, i.e., without the substrate being polished.

Figure 9:
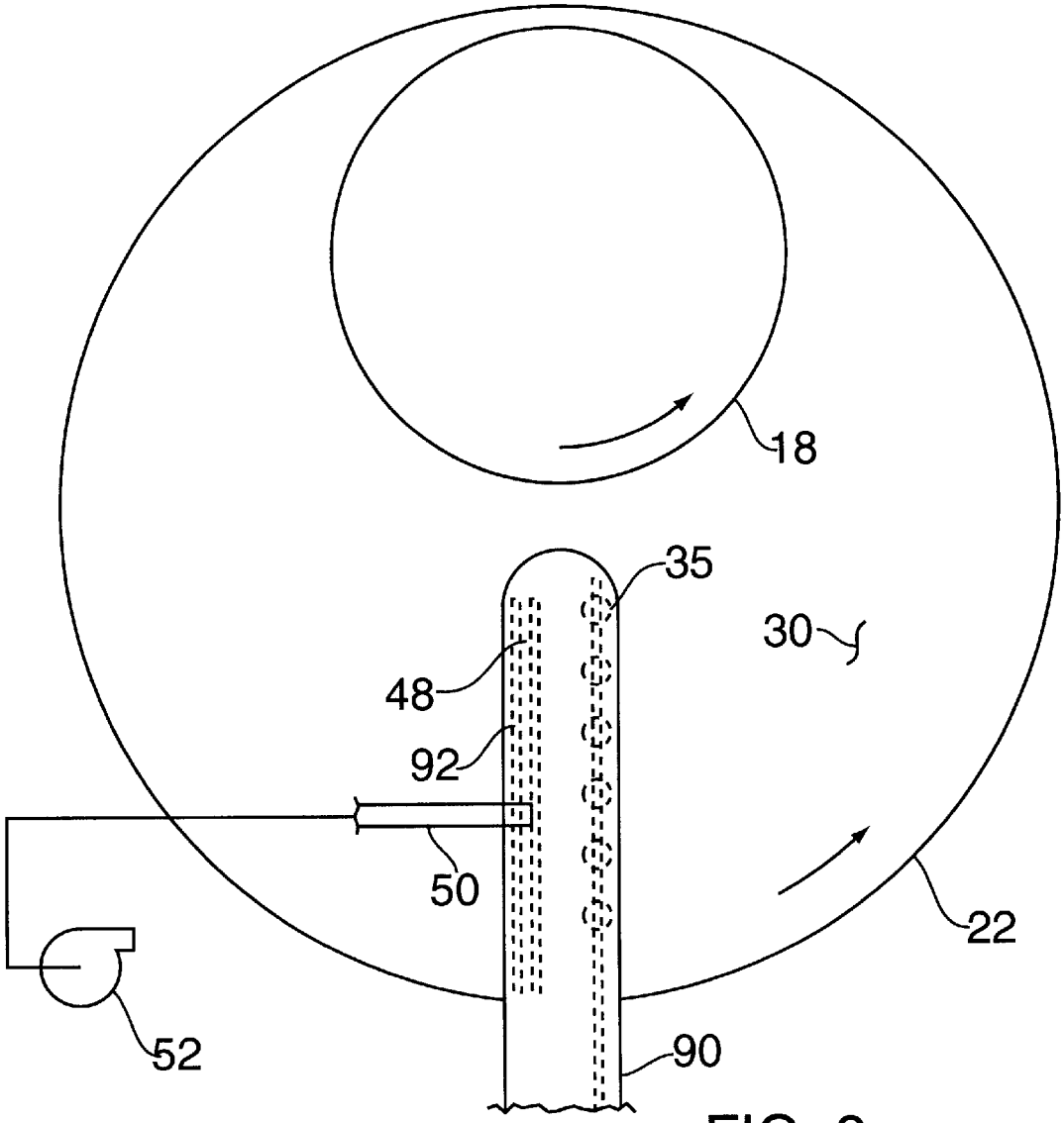
FIG. 9 is schematic top view of another embodiment of the fluid delivery system.

FIG. 9 is schematic top view of another embodiment of the fluid delivery system. A rinse arm 90 is similar to the rinse arm 24 shown in FIGS. 7 and 8, but has a combination of one or more nozzles 35 and a vacuum arm 92. The vacuum arm 92 includes a vacuum port 48. The rinse arm 90 is disposed toward the center of the pad 22. The nozzles 35 are preferably disposed on one side of the rinse arm 90 and are mounted to spray the rinse fluid preferably away from the vacuum arm 92. The vacuum arm 92 is disposed on the other side of the bottom surface of the rinse arm 90 and in close proximity to the pad surface 30. A vacuum source 52 provides a vacuum through a vacuum conduit 50 to the vacuum arm 92, similar to the vacuum arm 46.

Figure 10:
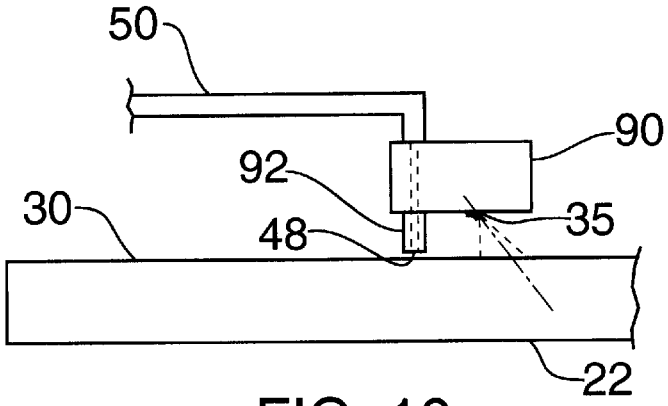
FIG. 10 is a side schematic view of the embodiment shown in FIG. 9.

FIG. 10 is a side schematic view of the rinse arm embodiment shown in FIG. 9. The rinse arm 90 is disposed above the pad surface 30. The vacuum arm 90 is disposed on one side and is in close proximity to the surface. The nozzles 35 are mounted so that the rinse fluid that is sprayed from the nozzles is directed preferably away from the vacuum arm.

The above described processes can be used to advantage in any CMP apparatus configuration. In multiple platen systems, such as a MIRRA™ system, polishing pads may be mounted on all three platens and the rinse performed at each polishing pad. The vacuum cleaning and high pressure rinse can be used selectively either separately or in combination with each other.

While the foregoing is directed to embodiments of the present invention, other and further embodiments of the invention may be devised without departing from the basic scope thereof, and the scope thereof is determined by the claims that follow.

What is claimed is:

1. A method of cleaning a fixed-abrasive polishing pad, comprising:

providing a rinse fluid at a rinse fluid pressure at least about 300 psi to a plurality of nozzles;

delivering the rinse fluid from the nozzles to a fixed-abrasive polishing pad at a first angle between about 5° and about 85° measured between a centerline of the rinse fluid delivered from the nozzles and the surface of the fixed-abrasive polishing pad to enhance removal of debris lodged on the fixed-abrasive polishing pad; and directing the rinse fluid from the nozzles to the fixed-abrasive polishing pad at a second angle between about 5° and about 85° measured between the centerline of the rinse fluid delivered form the nozzles and a pad radius defined from a center to an edge of the fixed-abrasive polishing pad to direct dislodged debris to a perimeter of the fixed-abrasive polishing pad.

2. The method of claim 1, wherein the first angle is between about 40° and about 50°.

3. The method of claim 1, wherein the second angle is between about 40° and about 50°.

4. The method of claim 1, further comprising vacuuming the fixed-abrasive polishing pad.

5. A method of cleaning a polishing pad, comprising:

providing a rinse fluid at a rinse fluid pressure at least about 300 psi to a plurality of nozzles;

delivering the rinse fluid from the nozzles to a polishing pad at a first angle between about 40° and about 50° measured between a centerline of the rinse fluid delivered from the nozzles and the surface of the polishing pad; and directing the rinse fluid from the nozzles to the polishing pad at a second angle between about 5° and about 85° measured between the centerline of the rinse fluid delivered form the nozzles and a pad radius defined from a center to an edge of the polishing pad.

6. The method of claim 5, wherein the second angle is between about 40° and about 50°.

7. The method of claim 5, further comprising vacuuming the polishing pad.

* * * * *